US009249614B1

(12) United States Patent
Mucciolo

(10) Patent No.: US 9,249,614 B1
(45) Date of Patent: Feb. 2, 2016

(54) INSULATION RETAINER FOR ATTIC ACCESS DROP PANELS

(71) Applicant: Charles Anthony Mucciolo, Boynton Beach, FL (US)

(72) Inventor: Charles Anthony Mucciolo, Boynton Beach, FL (US)

( * ) Notice: Subject to any disclaimer, the term of this patent is extended or adjusted under 35 U.S.C. 154(b) by 0 days.

(21) Appl. No.: 14/328,354

(22) Filed: Jul. 10, 2014

Related U.S. Application Data

(60) Provisional application No. 61/942,787, filed on Feb. 21, 2014.

(51) Int. Cl.
*E06B 5/00* (2006.01)
*E06B 5/01* (2006.01)

(52) U.S. Cl.
CPC ..... *E06B 5/01* (2013.01)

(58) Field of Classification Search
CPC ..... E04H 9/16; E04B 1/78; E04B 1/34; E04B 1/74; E04F 13/30; E04F 19/08; E02D 29/14; E06C 9/00; E06B 5/01
USPC ..... 52/19–20, 29, 198–199, 202, 205, 508, 52/404.1, 407.3, 407.4; 49/463, 465, 49/495.1, 496.1
See application file for complete search history.

(56) References Cited

U.S. PATENT DOCUMENTS

| | | | | | |
|---|---|---|---|---|---|
| 2,190,954 | A * | 2/1940 | Stickel | 220/592.06 |
| 3,238,573 | A * | 3/1966 | Pease, Jr. | 49/383 |
| 3,642,164 | A * | 2/1972 | O'Neal et al. | 220/592.04 |
| 4,483,102 | A * | 11/1984 | Edwards | 49/465 |
| 4,592,674 | A * | 6/1986 | Baliva | 404/25 |
| 4,637,752 | A * | 1/1987 | Centa | 404/25 |
| 4,807,397 | A * | 2/1989 | Doan | 49/498.1 |
| 4,944,126 | A * | 7/1990 | King | 52/202 |
| 5,404,676 | A * | 4/1995 | Devlin | 49/463 |
| 5,496,128 | A * | 3/1996 | Odill | 404/25 |
| 6,625,933 | B1 * | 9/2003 | Moeller | 52/19 |
| 6,701,676 | B1 * | 3/2004 | Kompelien | 52/19 |
| 7,770,353 | B2 * | 8/2010 | Olsen | 52/745.15 |
| 7,836,638 | B2 * | 11/2010 | Ogieglo | 52/19 |
| 7,849,644 | B2 * | 12/2010 | Melesky | 52/202 |
| 8,590,229 | B2 * | 11/2013 | Taylor et al. | 52/205 |
| 8,869,473 | B2 * | 10/2014 | Melesky | 52/202 |
| 2004/0055819 | A1 * | 3/2004 | Lynn et al. | 182/46 |
| 2007/0193136 | A1 * | 8/2007 | Olsen | 52/198 |
| 2009/0133342 | A1 * | 5/2009 | Copeland | 52/202 |
| 2009/0241434 | A1 * | 10/2009 | McCoy, Jr. | 52/19 |
| 2009/0277099 | A1 * | 11/2009 | Ogieglo | 52/19 |
| 2011/0265392 | A1 * | 11/2011 | Uhl et al. | 52/20 |

* cited by examiner

*Primary Examiner* — Beth Stephan
(74) *Attorney, Agent, or Firm* — Glenn E. Gold; Gold & Rizvi, P.A.

(57) ABSTRACT

An attic access drop panel for selectively closing a geometrically shaped attic passageway includes a rigid panel having an external periphery formed to fit within the structural elements defining the attic passageway and an insulating member on top of the rigid panel conforming to the external periphery of the rigid panel. A plurality of angle brackets are affixed about the periphery of the rigid panel wherein each bracket has a first leg affixed to the top of the rigid panel and a second leg extends upwardly from the top of the rigid panel. The second leg defines at least one protrusion engaging the insulating member and forms a bead at a top of the second leg for bearing against a structural element of the attic defining the attic passageway.

10 Claims, 9 Drawing Sheets

INSULATION RETAINER FOR ATTIC ACCESS DROP PANELS

CROSS-REFERENCE TO RELATED APPLICATIONS

This U.S. non-provisional patent application claims the benefit of U.S. provisional patent application No. 61/942,787, filed on Feb. 21, 2014, the entire contents of which are incorporated by reference herein.

FIELD OF THE INVENTION

The present invention relates generally to the field of building supplies used in the construction of offices, homes, and other insulated structures. More particularly, the present invention is directed to an insulated drop panel that is selectively removable from a passageway to gain access to an attic.

BACKGROUND OF THE INVENTION

Modern structures today typically have several insulated spaces such as attics, crawl spaces and the like. Frequently, to gain access to these insulated spaces, a passageway or portal is provided through which an inner non-exposed region may be accessed. These passageways, or portals, are usually covered by an access panel that is movably coupled to a supporting peripheral frame of the passageway. However, there are scenarios where the access panel may become dislodged from the frame and thereby leave the passageway exposed. Some scenarios include: inadequate fitting between the access panel and the frame; improper installation; structural pressure differentials (i.e., air handlers, hurricane, tornado, thunderstorms, etc.); and combinations thereof. When the access panel becomes dislodged from the peripheral frame, undesired airflow within the structure will result and may adversely affect the thermal efficiency of the structure.

Additionally, even if the access panel does not become dislodged, the panel is frequently devoid of insulation material utilized in the surrounding space. The absence of insulation on the access panel provides an undesired thermal conduit through which a transfer of thermal energy occurs between the insulated space and the occupied portion of the structure. In an attempt to reduce this undesired thermal transfer, insulation may be applied to the access panel; however, previous methods of coupling the insulation to the access panel have proven problematic.

In one known solution, a piece of insulation is merely placed behind the access panel when reinstalling the panel. This known solution, while somewhat useful, has substantial drawbacks. As commonly experienced by homeowners, servicemen and construction workers, the handling of insulation material, especially fiberglass-based materials, causes uncomfortable itching and other undesired health effects such as the inhalation of dislodged glass fibers. This solution requires that the insulation material be handled each time the access panel is removed. Further, this solution does not secure the insulation material with respect to the panel which, in some instances, may allow the insulation material to fall into the insulated space.

Another known solution employs stapling/nailing the insulated material to the back face of the access panel. While this method affixes the insulation to the panel, it presents a substantial drawback. In order to staple/nail the insulated material to the panel, the insulation must be compressed to allow the staple/nail to penetrate the insulation backing and securely enter the panel surface. By compressing the insulation material the thermal efficiency (i.e., R-rating) of the material is adversely affected. Further, the more staples/nails that are used the larger the compressed surface area—resulting in an even greater loss of thermal efficiency.

Another frequently employed solution is to use an adhesive to bond the insulation to the access panel. This solution also has substantial drawbacks. Applying adhesive to the back face of the access panel is time consuming and, depending on the cure time of the adhesive, may delay installation of the panel. Additionally, the use of an adhesive limits coupling of an adjacent layer of insulation to the panel. Since the fibers of fiberglass insulation are readily separable from adjacent fibers, this frequently results in separation of the insulation material layers and, consequently, may reduce the thermal efficiency of the material.

Efforts to provide an insulated access panel that overcomes the drawbacks, disadvantages and limitations inherent in the prior art have not met with significant success to date. As a result, there is a need in the art for an insulation retainer capable of coupling a segment of insulation to an access panel that facilitates panel installation and removal without requiring a user to separately handle the insulation material, does not compress the insulation material, enhances retention of the access panel within the passageway and prevents layer separation of the insulation material.

SUMMARY OF THE INVENTION

The present disclosure is generally directed to an attic access drop panel for selectively closing a geometrically shaped attic passageway defined by structural elements of the attic. The attic access drop panel includes a planar rigid panel having an external periphery formed to fit within the structural elements defining the geometrically shaped attic passageway. An insulating member is on top of and supported by the planar rigid panel wherein the insulating member substantially conforms to the extra periphery of the planar rigid panel. A plurality of retainers are affixed about the periphery of the planar rigid panel wherein each retainer has a first leg affixed to the top of the planar rigid panel and a second leg extending upwardly from the top of the planar rigid panel. The second leg defines at least one protrusion retentively engaging the insulating member. The second leg also forms a bead at a top thereof for bearing against a structural element of the attic defining the attic passageway.

In another aspect, the bead extends outward beyond the external periphery of the rigid panel.

In still another aspect, the first leg and the second leg to form an obtuse angle therebetween.

In yet another aspect, the obtuse angle is approximately 102 degrees.

In a still further aspect, the second leg is approximately 4 inches in length between the first leg and the top of the second leg.

In yet another aspect, the second leg forms a second bead below the bead at the top of the second leg.

In another aspect, the second leg defines at least two protrusions for retentively engaging the insulating member, the two protrusions are positioned between the first leg and the second bead.

In another aspect, the second leg defines at least two protrusions for retentively engaging the insulating member; the two protrusions are positioned between the first leg and the bead at the top of the second leg.

In a still further aspect, the first leg defines a groove extending therealong and positioned approximately at a midpoint of the first leg.

In yet another aspect, a plurality of screws are utilized to affix the plurality of retainers to the planar rigid panel, each screw engages the first leg in the defined groove.

In another aspect, a retainer for fixing to a periphery of a planar rigid panel to form an attic access drop panel for retaining an insulating member thereon comprises a first leg for fixing to a top surface of the planar rigid panel and a second leg extending upwardly from the first leg. The second leg defines at least one protrusion extending inwardly in a direction of the first leg for engaging an insulating member and further forms a bead proximate to a top edge thereof.

In still another aspect, the first leg and the second leg intersect to form an apex therebetween and further wherein the bead extends outwardly from the second leg beyond the apex.

In yet another aspect, the first leg and the second leg form an obtuse angle at the apex.

In another aspect, the obtuse angle is approximately 102 degrees.

In still another aspect, the second leg is approximately 4 inches in length between the apex and the top of the second leg.

In a further aspect, the second leg forms a second bead below the bead at the top of the second leg.

In yet another aspect, the bead and the second bead combine to form an undulating wave.

In a still further aspect, the protrusion is wedge-shaped.

In another aspect, the second leg defines to wedge-shaped protrusions extending inwardly in a direction of the first leg, the two wedge-shape protrusions positioned between the apex and the bead.

In another aspect, the first leg defines a groove extending therealong and positioned approximately at a midpoint of the first leg.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
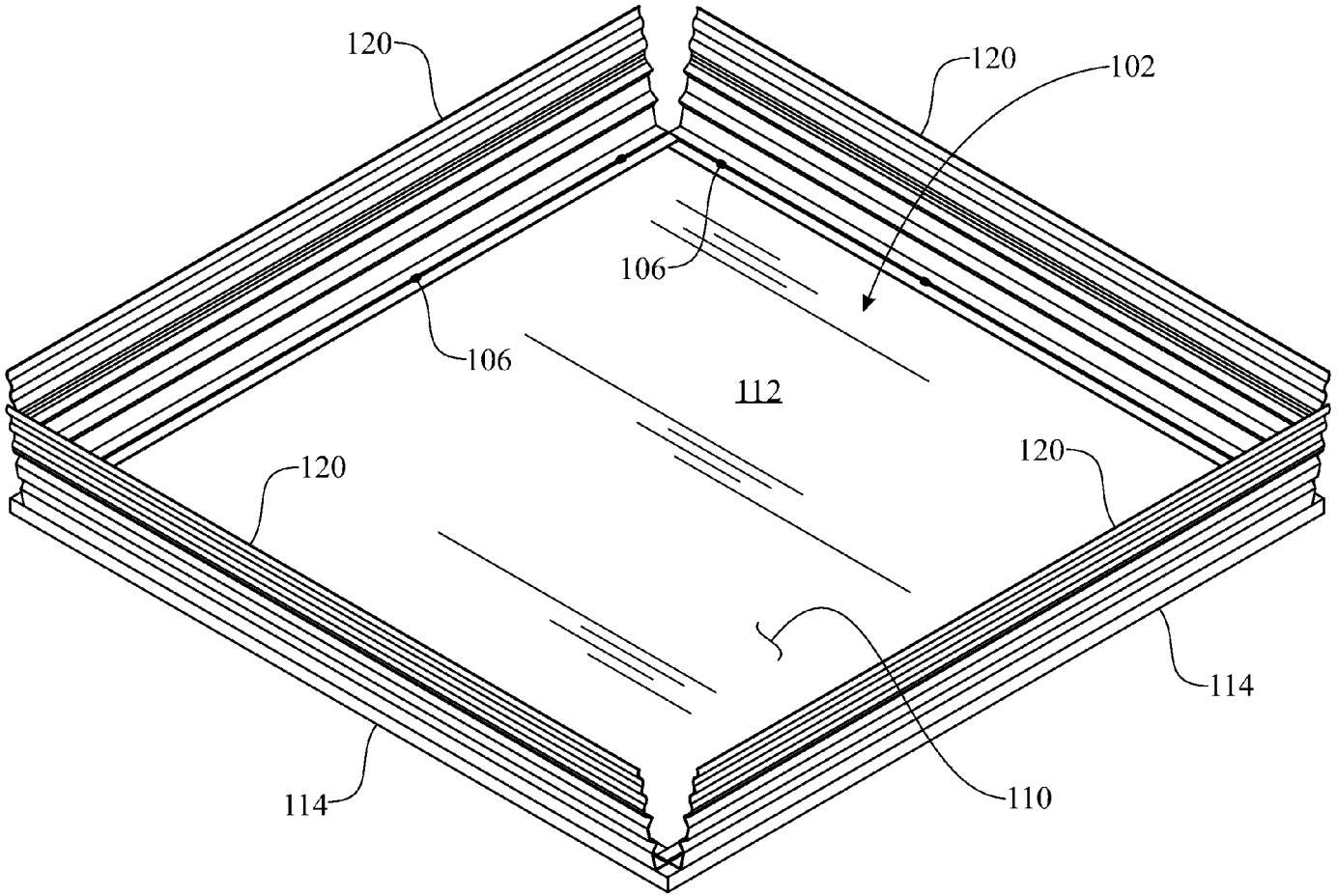
FIG. 1 presents an isometric view of an attic access drop panel embodying the present invention wherein an insulation layer is removed for clarity.

In one exemplary implementation of the invention, an attic access drop panel 100 is shown in FIG. 1 illustrating its various components wherein the attic access drop panel 100 is constructed of a planar rigid panel 110 having an upper surface 112 to which is fastened, utilizing a plurality of screws 106, a plurality of retainers 120 about a periphery 114 of the planar rigid panel 110. The planar rigid panel 110 is here shown having a rectangular plan form, however those practiced in the art will recognize that other geometric plan forms are contemplated herein. The retainers 120, in combination with the upper surface 112 of the planar rigid panel 110, define a cavity 102 in which an insulating member 118 (FIGS. 6-7) having external dimensions approximating the external dimensions of the periphery 114 of planar rigid panel 110 is retained. The planar rigid panel 110 can be fabricated from known construction materials such as gypsum board, plywood, or the like. The insulating member 118 can be constructed of known insulating materials such as fiberglass batts, rigid foam, or the like.

Figure 2:
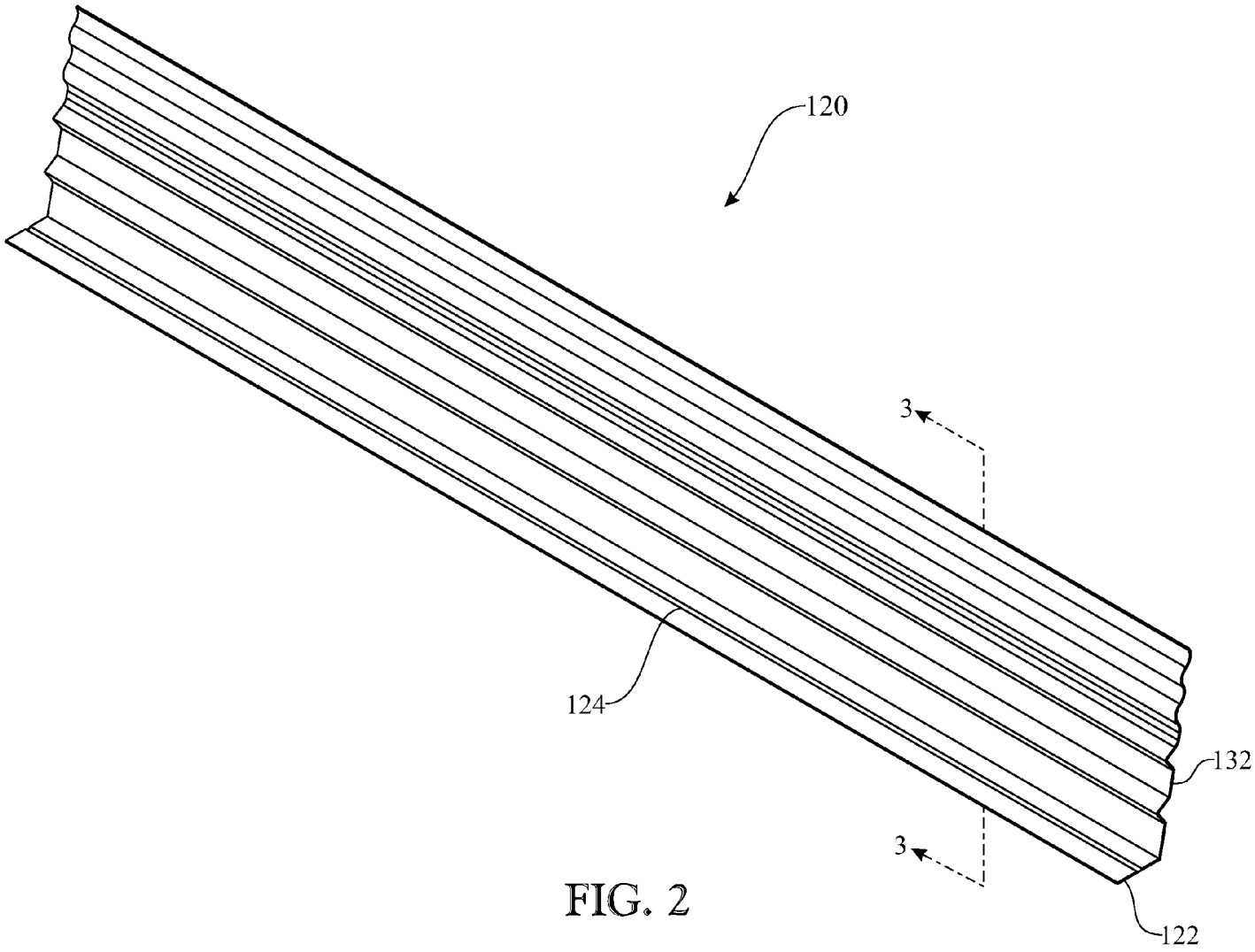
FIG. 2 presents an isometric view of a retainer of the attic access drop panel for retaining the insulation layer in the panel.
Figure 3:
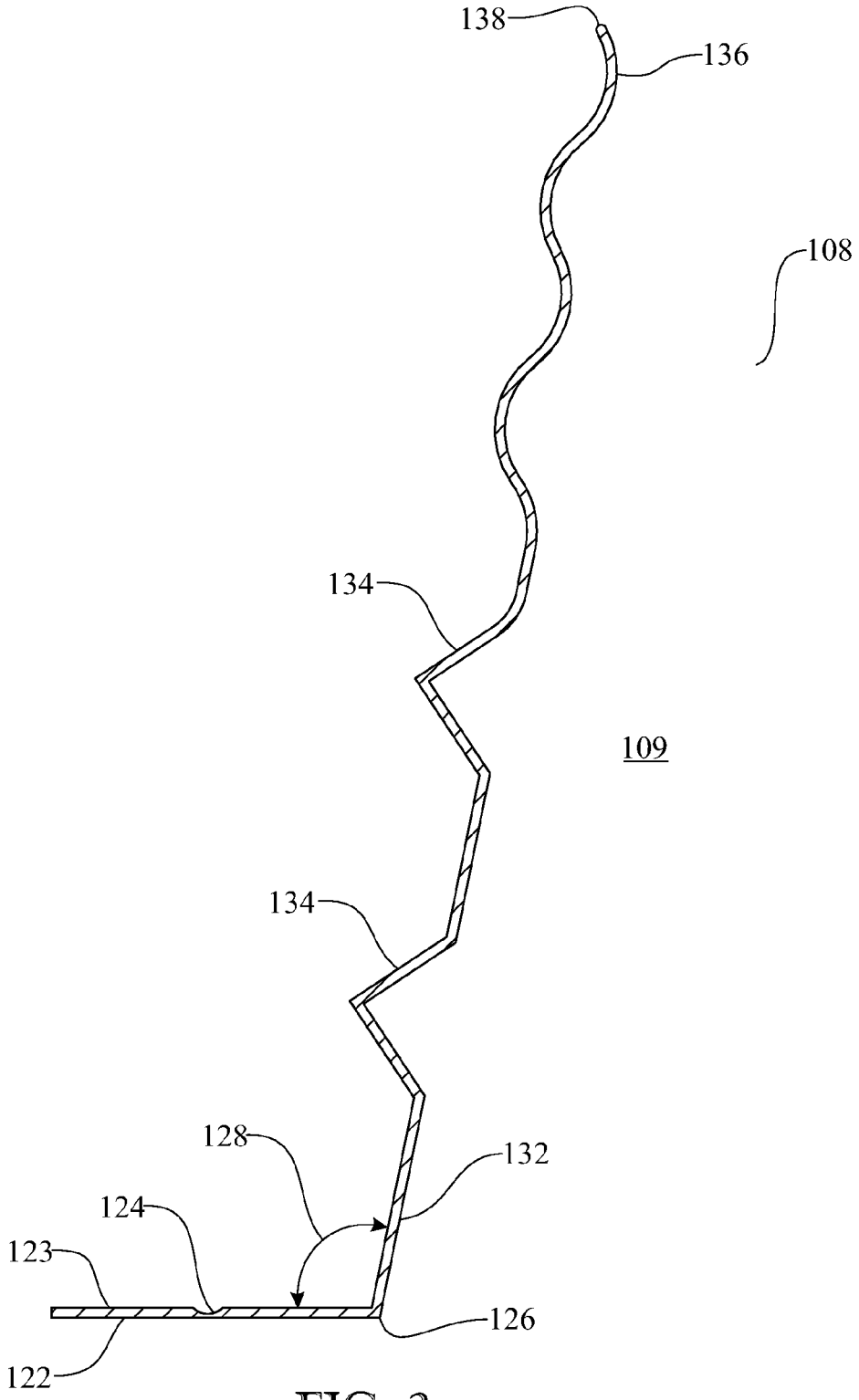
FIG. 3 presents a cross-sectional view of the retainer shown in FIG. 2 and taken along the line 3-3, FIG. 2.

As further illustrated in FIGS. 2-3, and most clearly seen in cross-section in FIG. 3, the retainer 120 has a first leg 122 for fastening to the top surface 112 of the rigid panel 110. In a most preferred embodiment the first leg 122 has a width of approximately 1.0 inch, and can define on an upper surface 123 thereof, a groove 124 to facilitate the placement of screws 106 (FIG. 1) for fastening the retainer 120 to the rigid panel 110. The retainer 120 also has a second leg 132 extending upwardly from the first leg 122 such that the first leg 122 and the second leg 132 adjoin at an apex 126 defining an obtuse included angle of approximately 102°. In a most preferred embodiment the second leg 132 has a length of approximately 4.0 inches from apex 126 to a top edge 138 thereof. The second leg 132 has formed in a lower portion thereof at least one and most preferably two spaced apart, wedge-shaped protrusions 134 extending unidirectionally with the first leg 122. Further, a top portion of the second leg 132 is formed as an undulating wave forming at least one and most preferably two spaced apart beads 136 extending away from the first leg 122.

Figure 4:
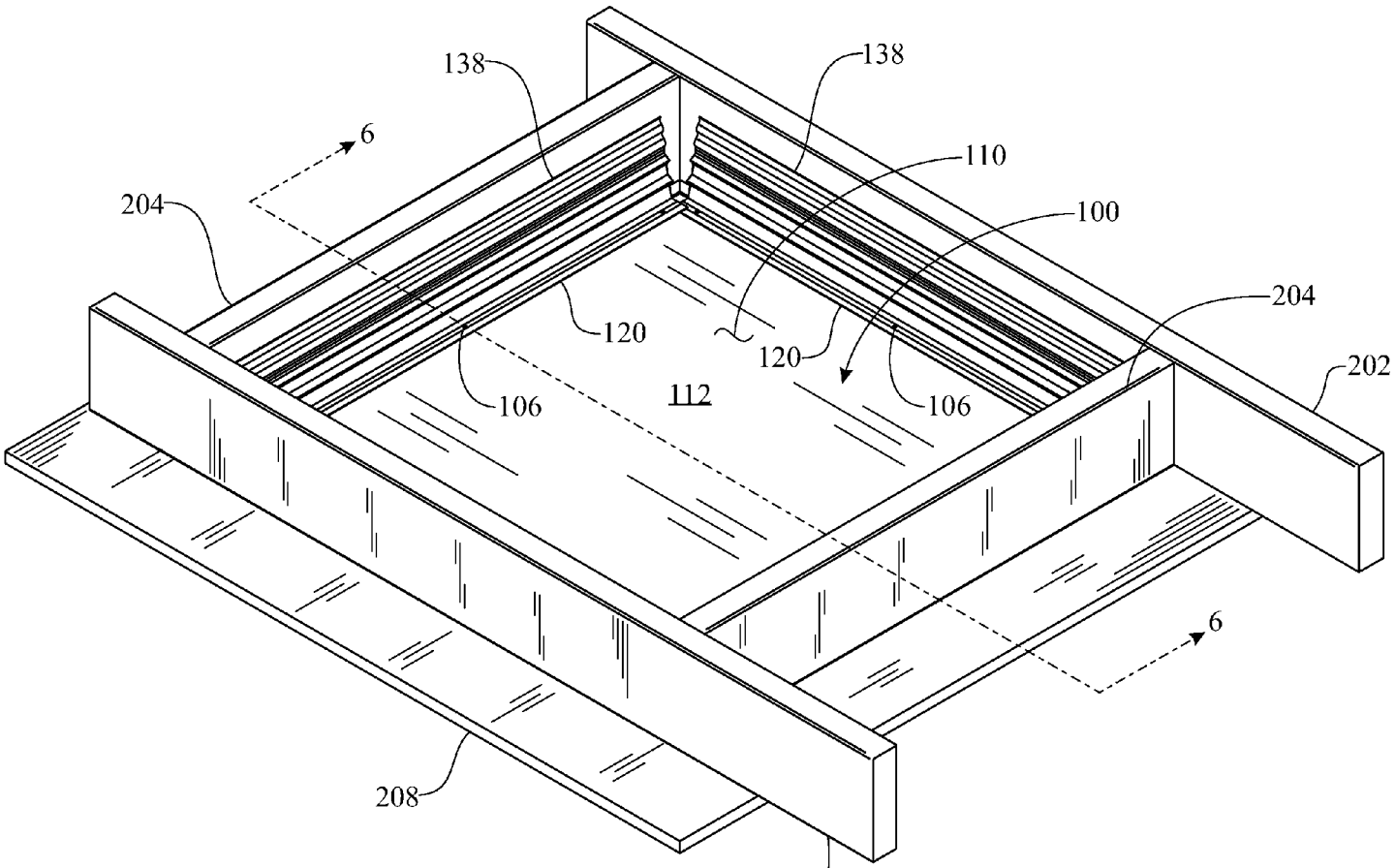
FIG. 4 presents an isometric view of an attic access drop panel seated in and closing an attic access passageway wherein the structure defining the attic access passageway is constructed of 2-inch×6-inch lumber.
Figure 5:
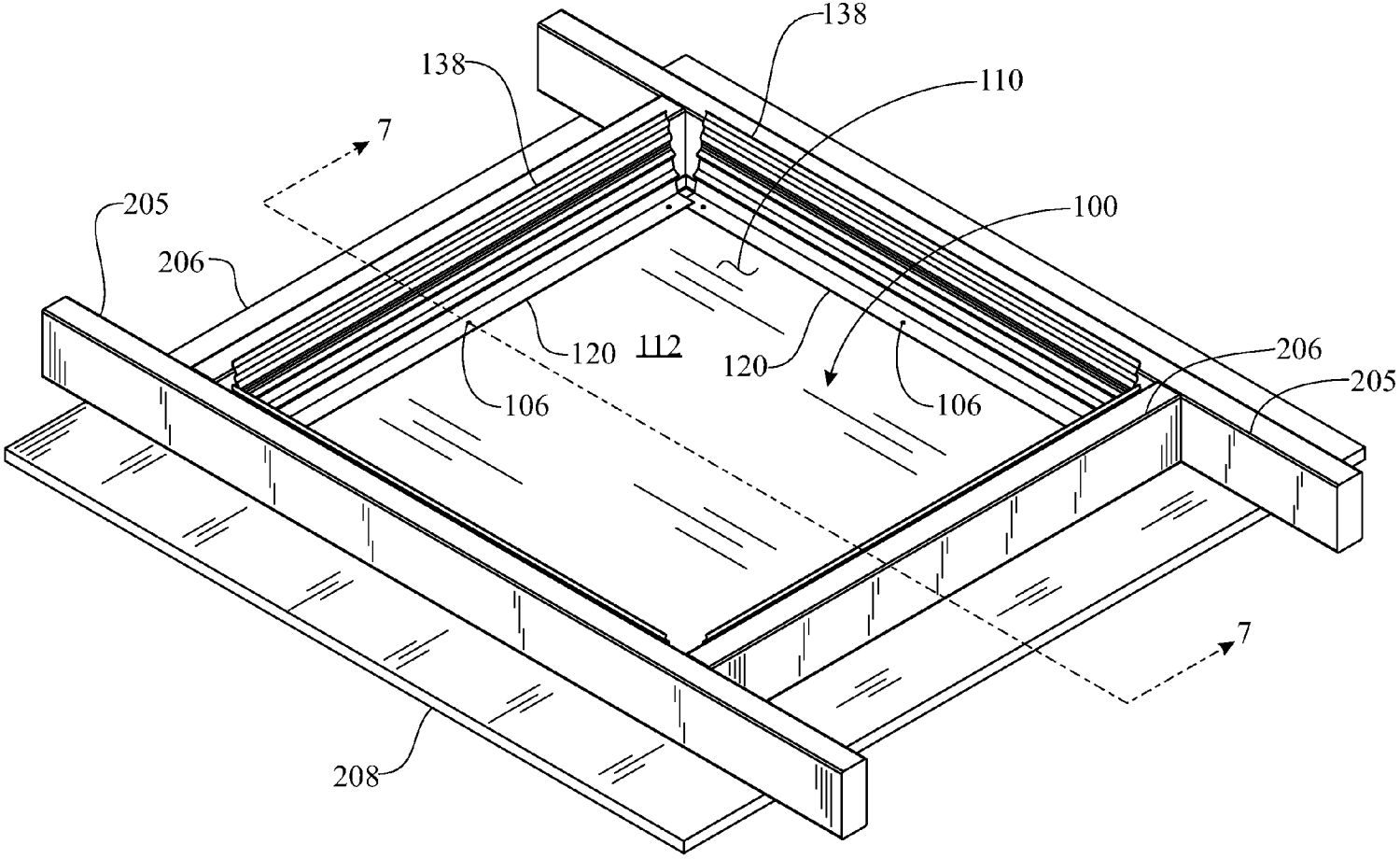
FIG. 5 presents an isometric view of an attic access drop panel seated in and closing an attic access passageway wherein the structure defining the attic access passageway is constructed of 2-inch×4-inch lumber.
Figure 6:
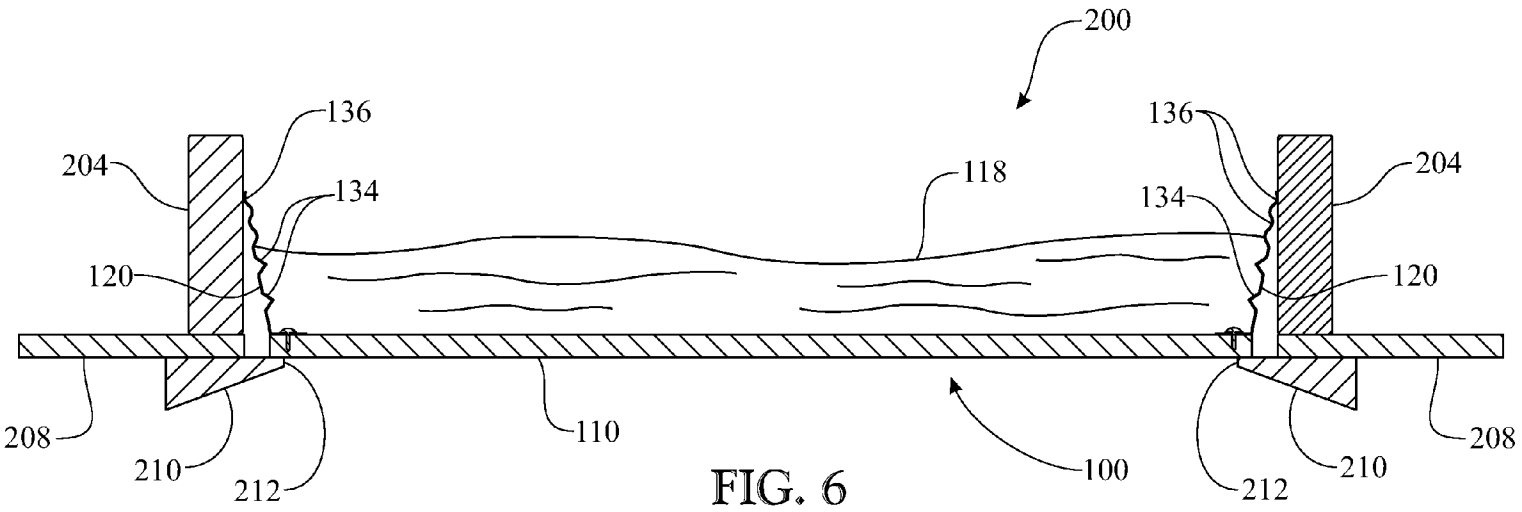
FIG. 6 presents a cross-sectional view of the attic access drop panel seated in and closing the attic access passageway of FIG. 4 and taken along section line 6-6, FIG. 4.
Figure 7:
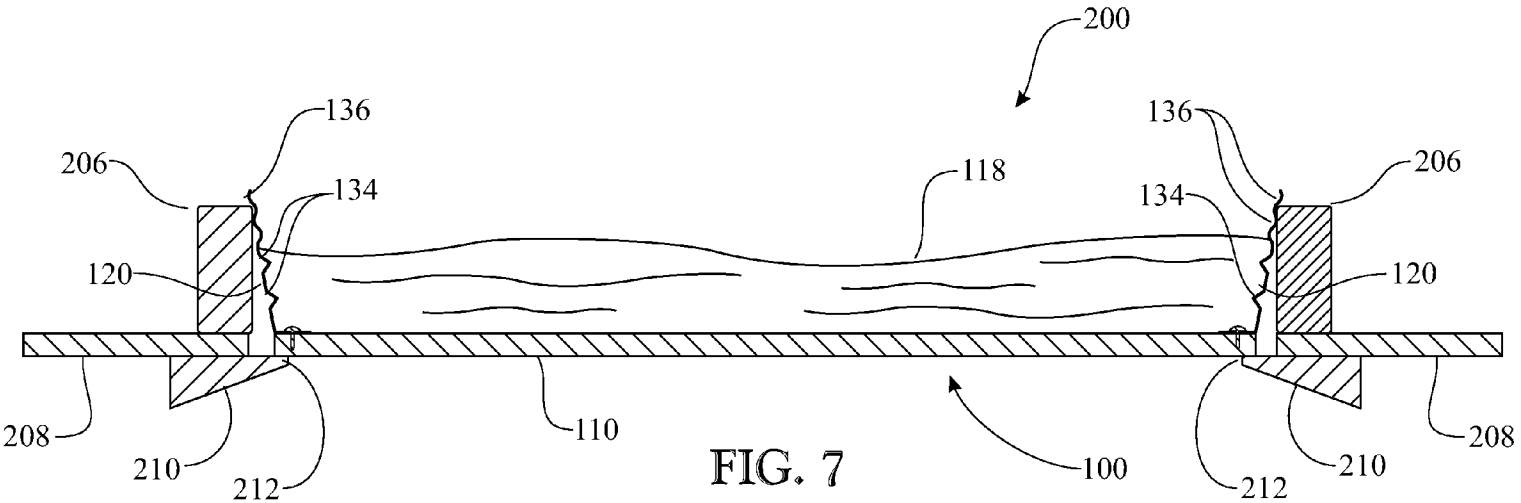
FIG. 7 presents a cross-sectional view of the attic access drop panel seated in and closing the attic access passageway of FIG. 5 and taken along section line 7-7, FIG. 5.

In use, and as illustrated in FIGS. 4-7, an attic access drop panel 100 is shown engaged in and to close an attic passageway 200. In FIGS. 4-5, the insulating member 118 has been deleted for the sake of clarity. As shown in FIGS. 4 and 6, the passageway 200 is defined by spaced apart 2-inch×6-inch lumber segments 202, which could be lower members of a roof truss or other similar structural assembly. Interstitial 2-inch×6-inch lumber segments 204 extend between lumber segments 202 to fully define a rectilinear periphery of the attic passageway 200. Panels 208, such as gypsum panel, are typically affixed to the lumber segments 202, 204 to form the ceiling of a room below the structure 202, 204 defining the passageway 200. Typically, the attic passageway 200 will be further defined by trim segments 210 affixed to the bottom surface of panels 208 and arranged in a manner such that an inner edge of the trim segments 210 extends into the attic passageway 200 forming a lip 212.

The rigid panel 110 of the attic access drop panel 100 is formed to have an outer periphery smaller than the portion of the attic passageway 200 defined by the lumber segments 202, 204 and larger than the inner periphery of the attic passageway 200 defined by the lip 212. In this manner, the attic access drop panel 100 when placed in the attic passageway 200 will rest upon the lip 212. Further, the retainers 120, by reason of the obtuse included angle 128, extend outwardly beyond the periphery of the rigid panel 110 in a manner such that the upper portion thereof contacts and bears upon the inner surface of structural segments 202, 204. In particular, since the structural segments 202, 204 are 2-inch×6-inch lumber, an uppermost bead 136 of retainers 120 bear upon the structural segments 202, 204.

As illustrated in FIGS. 5 and 6, the attic passageway 200 can alternatively be defined by structural segments 205, 206 wherein the structural segments 205, 206 are fabricated from 2-inch×4-inch lumber (Note: The remaining features and construction of the attic passageway 200 are identical as those described with respect to FIGS. 4 and 6). In this configuration, the uppermost of the beads 136 of retainers 120 extends above the structural elements 205, 206 and thus a next lower bead 136, in turn, bears against the inner surfaces of the structural elements 205, 206.

Therefore, regardless of the use of 2-inch×6-inch lumber or the use of 2-inch×4-inch lumber to construct the attic structure, a bead 136 of the retainers 120 will bear against the inner surface of the structure defining the attic passageway 200, thereby providing an effective seal inhibiting airflow therethrough. Further, the installation of the attic access drop panel 100 within the attic passageway 200 as defined by the structural elements 202, 204 or the structural elements 205, 206 deforms the second leg 132 towards an interior of the attic passageway 200. This deformation forces the wedge-shaped protrusions 134 against the edges of the insulating member 118, thereby resulting in the positive retention of the insulating member 118 above the rigid panel 110.

Figure 8:
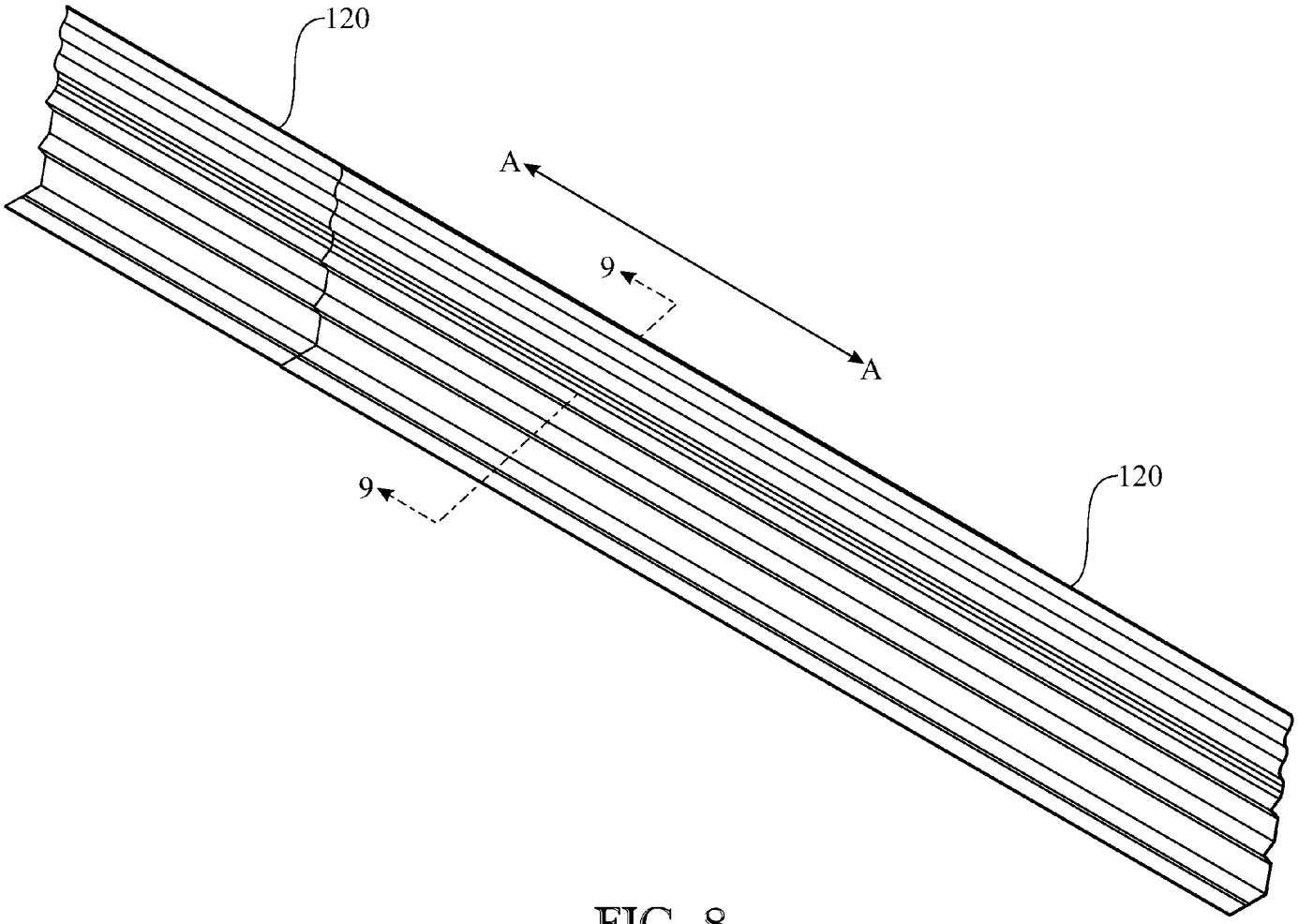
FIG. 8 presents an isometric view of a first retainer nested in a second retainer wherein the retainers are longitudinally translatable one with respect to the other.
Figure 9:
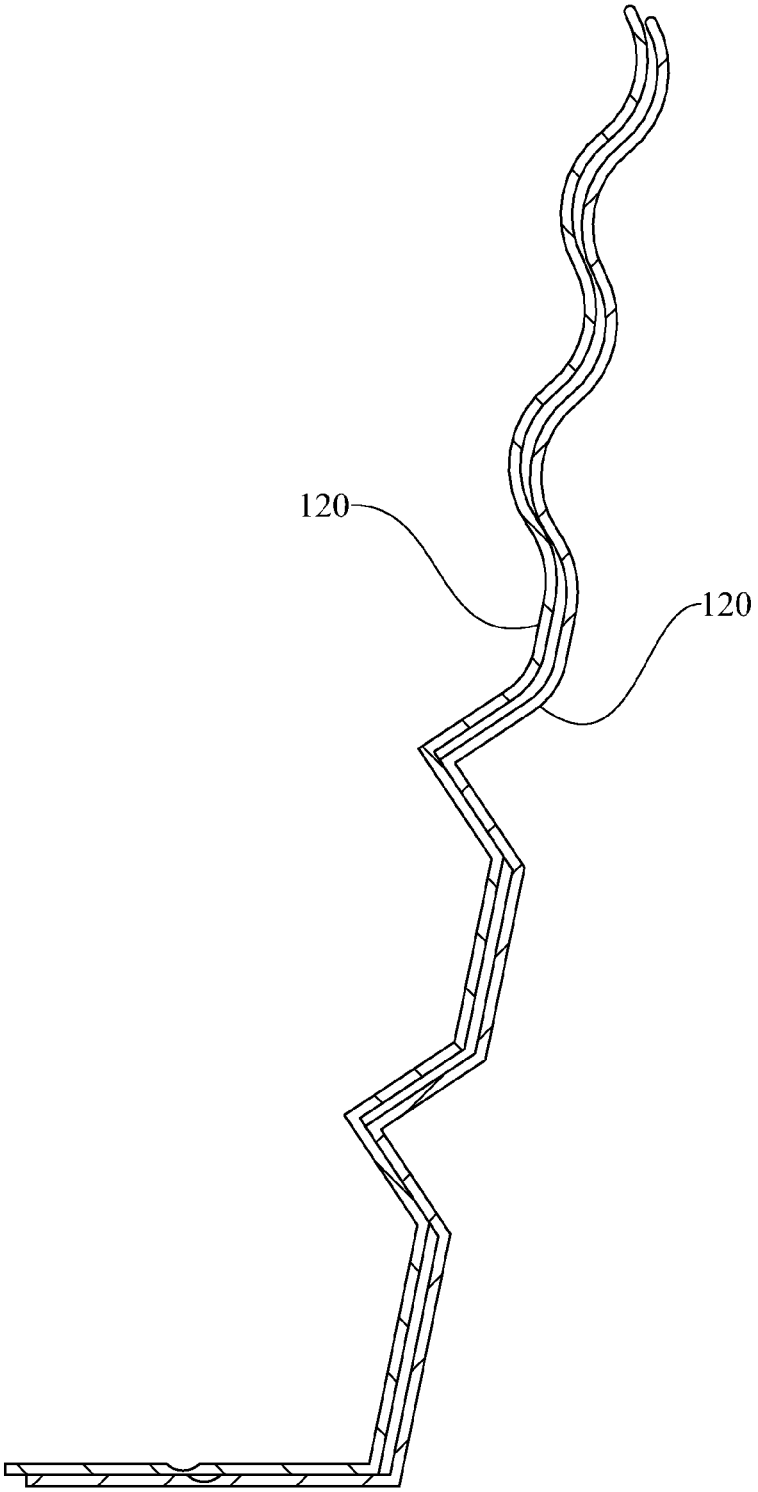
FIG. 9 presents a cross-sectional view of the nested retainers shown in FIG. 8 and taken along section line 9-9, FIG. 8.

Referring now to FIGS. 8-9, a first retainer 120 is illustrated in a nesting type relationship with an identical retainer 120. The retainers 120 can be longitudinally translated one with respect to the other as illustrated by arrows A-A (FIG. 8). In this manner, two retainers 120 can be utilized to conform to an edge dimension of the rigid panel 110 that is greater in length than a single retainer 120.

Figure 10:
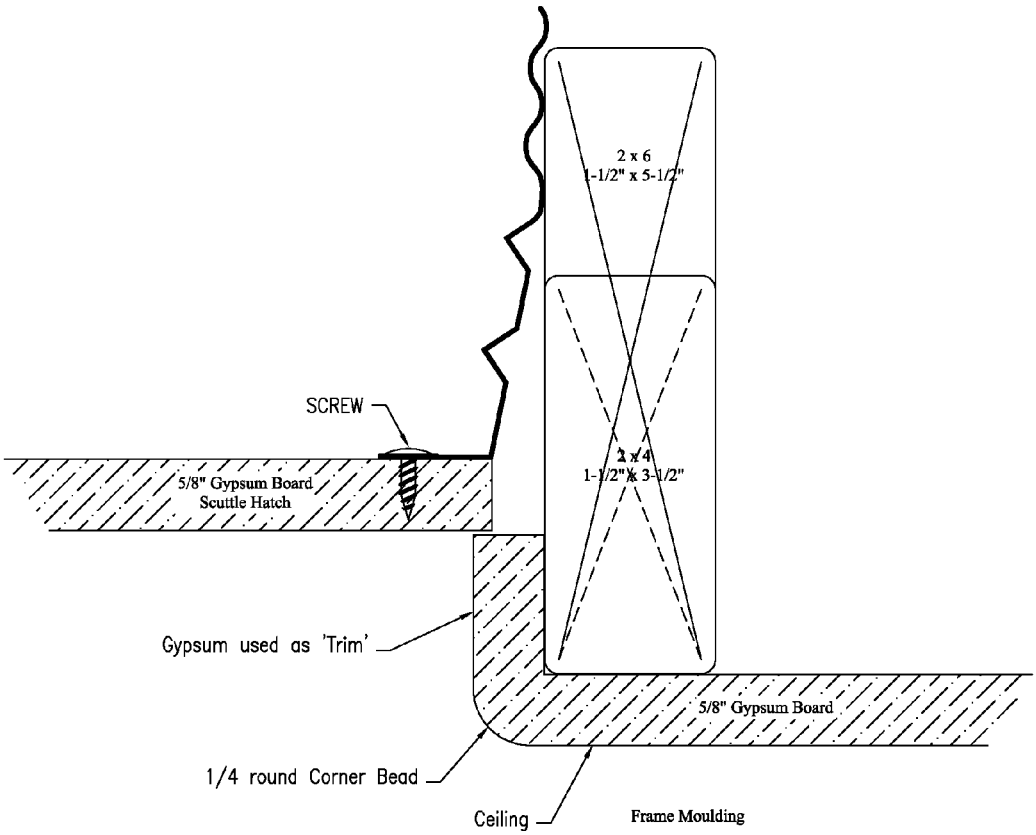
FIG. 10 presents an implementation of the invention with an exemplary alternate configuration of the trim component of an access passageway common in some homes.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents. For example, referring now particularly to FIG. 10, in an alternative implementation of the invention, and alternate configuration of the trim component of an access passageway is shown, which is common in some homes. Rather than a piece of molding Moll forming the lip onto which the panel rests, some builders will wrap the edge of the opening with gypsum board and utilize the edges of the gypsum board as a supporting lip for the scuttle hatch.

What is claimed is:

1. An attic access drop panel for selectively closing a geometrically shaped attic passageway defined by structural elements of an attic, said attic access drop panel comprising:

a planar rigid panel having an external periphery formed to fit within the structural elements defining the geometrically shaped attic passageway;

an insulating member on top of and supported by said planar rigid panel; and a plurality of retainers affixed about said external periphery of said planar rigid panel, each said retainer having a first leg affixed to said top of said planar rigid panel and a second leg extending upwardly from said top of said planar rigid panel wherein said second leg defines at least one protrusion retentively engaging said insulating member, and further wherein said second leg forms a bead at a top thereof for bearing against one of the structural elements of the attic defining the attic passageway.

2. The attic access drop panel according to claim 1 wherein said bead extends outward beyond said external periphery of said rigid panel.

3. The attic access drop panel according to claim 2 wherein said first leg and said second leg form an obtuse angle therebetween.

4. The attic access drop panel according to claim 3 wherein said obtuse angle is approximately 102 degrees.

5. The attic access drop panel according to claim 4 wherein said second leg is approximately 4 inches in length between said first leg and said top of said second leg.

6. The attic access drop panel according to claim 1 wherein said second leg forms a second bead between said first leg and said bead at said top of said second leg.

7. The attic access drop panel according to claim 6 wherein said second leg defines at least two protrusions retentively engaging said insulating member, said two protrusions positioned between said first leg and said second bead.

8. The attic access drop panel according to claim 1 wherein said second leg defines at least two protrusions retentively engaging said insulating member, said two protrusions positioned between said first leg and said bead at said top of said second leg.

9. The attic access drop panel according to claim 1 wherein said first leg defines a groove extending therealong and positioned approximately at a midpoint of said first leg.

10. The attic access drop panel according to claim 1 wherein a plurality of screws are utilized to affix said plurality of retainers to said planar rigid panel, each said screw engaging said first leg in said groove.

* * * * *